US011208612B2

(12) United States Patent
McGuiness et al.

(10) Patent No.: US 11,208,612 B2
(45) Date of Patent: Dec. 28, 2021

(54) MALEATED SOYBEAN OIL DERIVATIVES AS ADDITIVES IN METALWORKING FLUIDS

(71) Applicant: The Lubrizol Corporation, Wickliffe, OH (US)

(72) Inventors: Mark J McGuiness, Chagrin Falls, OH (US); Theodore Hammer, Akron, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 37 days.

(21) Appl. No.: 16/768,918

(22) PCT Filed: Dec. 4, 2018

(86) PCT No.: PCT/US2018/063844
§ 371 (c)(1),
(2) Date: Jun. 2, 2020

(87) PCT Pub. No.: WO2019/113068
PCT Pub. Date: Jun. 13, 2019

(65) Prior Publication Data

US 2021/0238496 A1 Aug. 5, 2021

Related U.S. Application Data

(60) Provisional application No. 62/596,334, filed on Dec. 8, 2017.

(51) Int. Cl.
*C10M 173/00* (2006.01)
*C10M 159/12* (2006.01)
*C10N 40/20* (2006.01)

(52) U.S. Cl.
CPC ..... *C10M 173/00* (2013.01); *C10M 159/12* (2013.01); *C10M 2201/02* (2013.01); *C10M 2201/06* (2013.01); *C10M 2215/04* (2013.01); *C10N 2040/20* (2013.01)

(58) Field of Classification Search
CPC ..... C10M 159/12; C10M 173/00; C10M 2201/02; C10M 2201/06; C10M 2207/123; C10M 2215/04; C10N 2030/12; C10N 2030/18; C10N 2030/24; C10N 2040/20; C10N 2050/01
See application file for complete search history.

(56) References Cited

U.S. PATENT DOCUMENTS

| | | | | |
|---|---|---|---|---|
| 5,030,388 | A * | 7/1991 | Martino | C11C 3/003 560/127 |
| 2009/0209441 | A1* | 8/2009 | Lange | C10M 173/00 508/239 |
| 2018/0070584 | A1* | 3/2018 | Meredith | A01N 25/02 |

FOREIGN PATENT DOCUMENTS

| | | | |
|---|---|---|---|
| RO | 114624 | B1 | 6/1999 |
| WO | 2005071050 | A1 | 8/2005 |
| WO | 2015120418 | A1 | 8/2015 |
| WO | 2016153913 | A1 | 9/2016 |

OTHER PUBLICATIONS

PCT Written Opinion of the International Searching Authority, dated Apr. 29, 2019.
PCT International Search Report, dated Apr. 29, 2019.
PCT Written Opinion of the International Searching Authority, dated Nov. 26, 2019.

* cited by examiner

*Primary Examiner* — James C Goloboy
(74) *Attorney, Agent, or Firm* — Iken Sans; Teresan Gilbert; Teresan W. Gilbert

(57) ABSTRACT

Compositions prepared from an adduct of mono-maleated polyunsaturated vegetable oil and an alcohol mixture comprising a hydrophobic alcohol having at least 9 carbon atoms and methoxypolyethylene glycol having a number average molecular weight ($M_n$) of at least 350. Metalworking fluids comprising less than 3 wt % of a composition that is an adduct of mono-maleated polyunsaturated vegetable oil and an alcohol mixture comprising an alcohol having at least 2 carbon atoms and methoxypolyethylene glycol having a number average molecular weight ($M_n$) of at least 350. Methods of improving the stability and/or lubricity of a metalworking fluid using a composition that is adduct of mono-maleated polyunsaturated vegetable oil and an alcohol mixture comprising an alcohol having at least 2 carbon atoms and methoxypolyethylene glycol having a number average molecular weight ($M_n$) of at least 350.

18 Claims, No Drawings

MALEATED SOYBEAN OIL DERIVATIVES AS ADDITIVES IN METALWORKING FLUIDS

CROSS REFERENCE TO RELATED APPLICATION

This application claims priority from PCT Application Serial No. PCT/US2018/063844 filed on Dec. 4, 2018, which claims the benefit of U.S. Provisional Application No. 62/596,334 filed on Dec. 8, 2017, both of which are incorporated in their entirety by reference herein.

FIELD OF THE INVENTION

The field of the disclosed technology is generally related to metalworking fluids comprising maleated soybean oil derivatives.

BACKGROUND OF THE INVENTION

Metalworking fluids can be divided into two broad categories: oil-based, and water-based. Oil-based fluids generally provide excellent lubrication and inherent corrosion protection to both the workpiece and tooling for a variety of metalworking operations. Oil-based fluids have several notable disadvantages as well. First, they are "dirty," i.e. they leave copious oily residues on the workpiece that must be removed by a subsequent cleaning operation. Second, they are significantly more expensive than water-based fluids due to the intrinsic higher cost of oils relative to water as the base solvent. Third, oil-based fluids are not nearly as good as water-based fluids for heat removal from the tool-workpiece interface because of the lower heat capacity and thermal conductivity of oil compared to water.

Water-based metalworking fluids have a complementary set of disadvantages: water itself is a horrible lubricant, it promotes corrosion of many metals, it has a high surface tension and therefore does not wet surfaces well, and it is a growth medium for potentially harmful bacteria and fungi. Water-based metalworking fluids have therefore traditionally required a complex set of additives to correct these inherent drawbacks.

Water-based metalworking fluids, sometimes referred to as "coolants" in the industry jargon, can be sub-divided into three categories: emulsifiable oils (also commonly called "soluble oils"); synthetics; and semi-synthetics.

Soluble oils are emulsions of oil and oil-soluble additives in water typically having a milky appearance. A typical soluble oil metalworking fluid will consist of about 5-10 wt % oil phase dispersed in the water. This range may be somewhat higher or lower depending on the application. The primary function of the emulsified oil phase is to provide lubricity for the metalworking operation (which is not provided by the aqueous phase). The base oil by itself will frequently not provide adequate lubricity, so auxiliary lubricity additives are frequently incorporated into the oil phase. These lubricity additives may be polymeric or oligomeric esters, alkyl phosphates, and the like. One key factor for a successful soluble oil formulation is the emulsifier (surfactant) package used to stabilize the emulsion. The combination of emulsifiers must provide a stable emulsion that will not separate over a period of weeks or even months whilst also retaining this performance in the presence of elevated levels of hard water, i.e. water-soluble divalent cations such as $Ca^{2+}$ and $Mg^{2+}$. Water hardness tends to increase over time in the sumps of metalworking equipment due to a boiler effect. Use of inexpensive emulsifiers such as fatty acid soaps that tend to precipitate in the presence of divalent metal ions can lead to destabilization of the soluble oil emulsion, causing separation of the oil phase. Another drawback of soluble oil type fluids is that they are also perceived to be "dirty," i.e. they tend to leave significant oily residues on finished parts.

Semi-synthetic metalworking fluids are similar to soluble oils except that generally they contain less oil and higher amounts of emulsifiers. This leads to a smaller droplet size distribution in the emulsion and consequently greater emulsion stability. Depending on the exact ratio of oil to emulsifiers and the composition of the emulsifier package, semi-synthetic metalworking fluids can vary in appearance from milky to almost completely clear, a translucent or hazy appearance being most typical. End-use concentrations of semi-synthetics are also typically in the 5-10 wt % range. Because of the lower oil to emulsifier ratio in semi-synthetics, the resulting emulsions typically have longer fluid life and greater tolerance to hard water buildup. Semi-synthetics are usually more expensive than soluble oils due to the fact that the formulation will tend to contain less inexpensive base oil and more of the costly additives, primarily in the form of emulsifiers.

Synthetic metalworking fluids contain no oil. The additives in synthetic metalworking fluids are all water soluble. The resulting fluids are therefore clear. Synthetics are generally perceived to be "clean" fluids because they leave less noticeable residues on the finished parts. Because there is no oil phase in these fluids, the lubricity provided by synthetic fluids generally tends to be inferior to soluble oils and semi-synthetics. What lubricity there is in synthetic fluids may be provided by surface active components that have an affinity for metal surfaces. Another lubricity mechanism commonly employed in synthetics is based on a cloud point phenomenon. Additives such as ethylene oxide-propylene oxide block polymers having aqueous cloud points just above room temperature are commonly employed for this purpose. Friction at the tool-workpiece interface causes localized heating that results in phase separation of these additives due to the cloud point effect. This deposits a lubricious organic phase in the heated region at the tool-workpiece interface. The bulk of the fluid, which does not experience the localized heating, remains clear.

All three categories of aqueous metalworking fluids share common performance challenges that must be addressed through the incorporation of water-soluble additives. These challenges are namely corrosion and bio-infestation. The first line of defense for prevention of corrosion in aqueous metalworking fluids is rigorous control of the pH. The corrosion rate of ferrous alloys can be significantly reduced by keeping the pH of the metalworking fluid alkaline. Various water soluble amines, such as alkanolamines, or inorganic alkalis such as alkali metal carbonates and borates are usually incorporated into aqueous metalworking formulations in order to provide reserve alkalinity.

For applications involving the machining of ferrous alloys, pH's in the range of about 8 to 10 are commonly employed. For aluminum alloys, however, pH's much above about 9 can cause dark surface staining, therefore fluids for aluminum machining are typically formulated to give pH's in the 7.5-8.5 range. Even with careful pH control, and incorporation of compounds to provide reserve alkalinity, aqueous metalworking fluids will almost without exception incorporate water-soluble corrosion inhibitors. Often, more than one type of corrosion inhibitor will be employed—one type to inhibit corrosion of ferrous alloys, and another type to inhibit corrosion of aluminum or yellow metals (copper-containing alloys)

The second major problem that all aqueous metalworking fluids face is that of unwanted biological growth. Many different species of bacteria, fungi, and molds can grow in aqueous metalworking fluids using the additives and oil as their food source. After the fluid becomes infested, the fluid-contacted surfaces of the metalworking equipment will usually become fouled with adhering biofilms which can result in localized corrosion of the equipment, and plug tubing, lines, and filters. As with corrosion inhibition, pH control is the first line of defense for protecting an aqueous metalworking fluid from biological infestation. Generally, the higher the pH the less hospitable the fluid will be to microorganisms, and at very high pH (about 10 and higher) biologic infestation is not problematic. Very high pH's are undesirable for a number of reasons, including aluminum staining mentioned previously as well as presenting skin and eye contact hazards for workers. For this reason, most aqueous metalworking fluids will incorporate one or more water-soluble biocidal ingredients.

Therefore, soluble oil and semi-synthetic metalworking fluids are inherently complex formulations. In addition to the water and base oil, such formulations will typically require two or more emulsifiers, a lubricity additive, one or more corrosion inhibitors, an inorganic alkali, an alkanolamine for reserve alkalinity, and one or more biocides. It is therefore not uncommon for these types of fluids to contain eight or more ingredients (in addition to water).

US 2009/0209441 "Maleated Vegetable Oils and Derivatives, as Self-Emulsifying Lubricants in Metalworking" describes how soybean oil and other polyunsaturated vegetable oils can be rendered self-emulsifying via reaction with maleic anhydride, followed by ring-opening of the anhydride moiety with water soluble alcohols or alkanolamines. These compositions, however, suffer from very poor tolerance to hard water.

Thus, there is a need for aqueous metalworking fluids that have a soluble lubricant and are stable in hard water, and do not require multiple ingredients.

SUMMARY OF THE INVENTION

Accordingly, a multifunctional composition is disclosed that, when added to a metalworking fluid, reduces the amount of other ingredients required. The disclosed technology provides compositions and metalworking fluids suitable for use as soluble oil or semi-synthetic metalworking fluids. These metalworking fluids have significantly simpler formulation and lower overall treat rates compared to the aforementioned traditional categories of aqueous metalworking fluids. The compositions also remain in solution as the hardness of the aqueous portion increases, resulting in a stable aqueous metalworking fluid.

The composition may be prepared from an adduct of mono-maleated polyunsaturated vegetable oil and an alcohol mixture. The alcohol mixture may comprise an alcohol having at least 2 carbon atoms and methoxypolyethylene glycol having a number average molecular weight ($M_n$) of at least 350. In some embodiments, the methoxypolyethylene glycol has a number average molecular weight ($M_n$) of at least 350 to at least 550.

The mono-maleated polyunsaturated vegetable oil may be prepared by reacting maleic anhydride (MAA) with a polyunsaturated vegetable oil in a molar ratio of maleic anhydride to polyunsaturated vegetable oil of 1:<2, 1:1.75, 1:1.5, 1:1.25, or 1:1.

In some embodiments, the mono-maleated polyunsaturated vegetable oil may then be reacted with an alcohol mixture comprising an alcohol that is a linear or branched $C_2$ to $C_{18}$ alcohol. In other embodiments, the alcohol mixture may comprise a hydrophobic alcohol that is a linear or branched $C_9$ to $C_{18}$ alcohol ("fatty alcohol"). In other embodiments, the hydrophobic alcohol may comprise at least one linear or branched $C_9$ to $C_{11}$ oxo alcohol, a linear or branched $C_{12}$ to $C_{14}$ fatty alcohol, or combinations thereof.

In one embodiment, the molar ratio of the mono-maleated polyunsaturated vegetable oil to the alcohol mixture may range from 2:1 to 1:2. In yet another embodiment, the ratio may be 1:1. In one embodiment, the polyunsaturated vegetable oil used to prepare the composition may be soybean oil.

In another embodiment, the adduct of mono-maleated polyunsaturated vegetable oil and an alcohol mixture by be salted using an alkali metal base or an amine. Suitable alkali metals bases can include, but are not limited to, sodium or potassium bases. Suitable amines include tertiary amines, such as tertiary alkanolamines. Exemplary tertiary alkanol amines include, but are not limited to, triethanolamine, N,N-dimethylethanolamine, N-butyldiethanolamine, N,N-diethylethanolamine, N,N-dibutylethanolamine, or mixtures thereof. In yet another embodiment, the tertiary amine may comprise triethanolamine.

Aqueous metalworking fluid compositions comprising a composition prepared from an adduct of mono-maleated polyunsaturated vegetable oil and an alcohol mixture are also disclosed. The composition may be as described above. In some embodiments, the composition may be present in an amount of less than 3 wt % based on a total weight of the fluid composition. In some embodiments, the composition may remain dispersed in the fluid when the water has a hardness of at least 400 ppm $CaCO_3$, based on a total weight of the fluid.

In yet other embodiments, methods of lubricating a metal component are disclosed. The methods may comprise contacting the metal component with an aqueous metalworking fluid comprising a composition prepared from an adduct of mono-maleated polyunsaturated vegetable oil and an alcohol mixture as described above. In some embodiments, the metal component may be aluminum or steel.

Methods of improving the stability and/or lubricity of a metalworking fluid by adding the composition described above to a metalworking fluid are also disclosed. In some embodiments, the composition may be present in an amount of less than 3 wt % based on a total weight of the metalworking fluid. Uses of the composition described above to improve the stability and/or lubricity of a metalworking fluid are also disclosed.

DETAILED DESCRIPTION OF THE INVENTION

Soybean oil reacted with about 1 mole of maleic anhydride per mole of soybean oil yields an intermediate which when further reacted with a combination of a hydrophobic alcohol and methoxypolyethylene glycol in a molar ratio of about 2:1:1 gives a multi-functional material that enables formulation of extremely simple aqueous metalworking fluids. When neutralized with alkanolamines such as triethanolamine (TEA) the maleated soybean oil derivative is water-dispersible and exhibits excellent lubricity in metal cutting and forming applications on steel and aluminum. As such, the composition can serve as a "single component" replacement for traditional soluble oil or semi-synthetic metalworking fluids, giving a significant reduction in cost and complexity. These "single component" metalworking fluids exhibit good stability in hard water, and contain no phosphorus, sulfur, boron, or heavy metals. Useful treat rates for the composition, or "single component" metalworking concentrate, are in the range of less than 4 wt %, or 0.5 to 3 wt %, or 1-2 wt % of the total weight of the metalworking fluid, compared to treat rates of 5-10 wt % for conventional soluble oil and semi-synthetic metalworking concentrates.

Accordingly, a multifunctional composition is disclosed that, when added to a metalworking fluid, reduces the amount of other ingredients required. Various features and embodiments will be described below by way of non-limiting illustration.

The composition may be prepared from an adduct of mono-maleated polyunsaturated vegetable oil reacted with an alcohol mixture. The alcohol mixture may comprise an alcohol having at least 2 carbon atoms and methoxypolyethylene glycol having a number average molecular weight ($M_n$) of at least 350. In some embodiments, the methoxypolyethylene glycol has a number average molecular weight ($M_n$) of at least 350 to at least 550. The number average molecular weight of the methoxypolyethylene glycol materials described herein is measured by hydroxyl number titration of the terminal OH groups.

Suitable oils for making the compositions are not overly limited and include any triglyceride oil having on average at least one polyunsaturated fatty acid tail, such as linoleic acid or linolenic acid. The term "triglyceride oil" signifies a glycerol triester of the same or mixed fatty acids. Fatty acid refers to straight chain monocarboxylic acids having a carbon chain length of from $C_{12}$ to $C_{22}$.

Exemplary triglyceride oils include vegetable oils. Vegetable oils are an inexpensive, readily-available, renewable raw materials that exhibit good lubricity. Soybean oil is preferred, on a purely economic basis, due to its low cost and commercial abundance; there is no chemical or performance basis on which to favor soybean oil to any of the alternative triglyceride oils mentioned here. Alternative triglyceride oils useful herein are, for example, corn oil, sunflower oil, safflower oil, linseed oil, cotton seed oil, tung oil, peanut oil, dehydrated castor oil, and the like.

Triglyceride oils are generally insoluble in water, however, so for use in water-based metalworking fluids they must be either (a) emulsified, or (b) rendered water soluble or dispersible via chemical functionalization. The functionalization of vegetable oils (including soybean oil and related unsaturated triglycerides) may be accomplished via high-temperature Diels-Alder and/or ene reactions.

In these reactions, the vegetable oil may be reacted with an electron-deficient alkene. Suitable electron-deficient alkenes include, but are not limited to, maleic acid, fumaric acid, citraconic acid, citraconic anhydride, itaconic acid, itaconic anhydride, bromomaleic anhydride, and dichloromaleic anhydride, and maleic anhydride (MAA). In one embodiment, the alkene is maleic anhydride.

Without limiting this technology to a single theory, it is believed, however, that the disclosed adduct of polyunsaturated vegetable oil and electron-deficient alkene is predominantly the adduct of the Diels-Alder reaction. This is based on IR and wet chemical analysis of the disclosed adducts. Accordingly, only the Diels-Alder adducts of maleic anhydride and soybean oil will be shown for illustrative purposes going forward; any minor amounts of ene-type adducts will be ignored.

The thermal reaction between maleic anhydride and soybean oil produces a mixture of species as illustrated below. Regardless of the molar ratio of maleic anhydride to soybean oil used for the reaction, each the four species shown below will be produced to some extent because each of the fatty acid tails of the triglyceride react independently of each other.

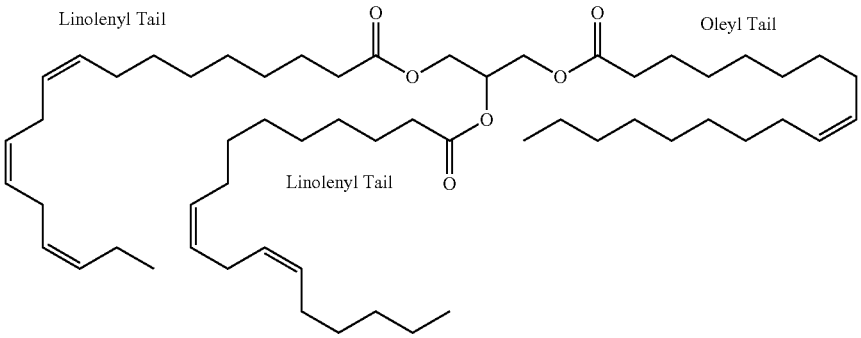

Unreacted Soybean Oil

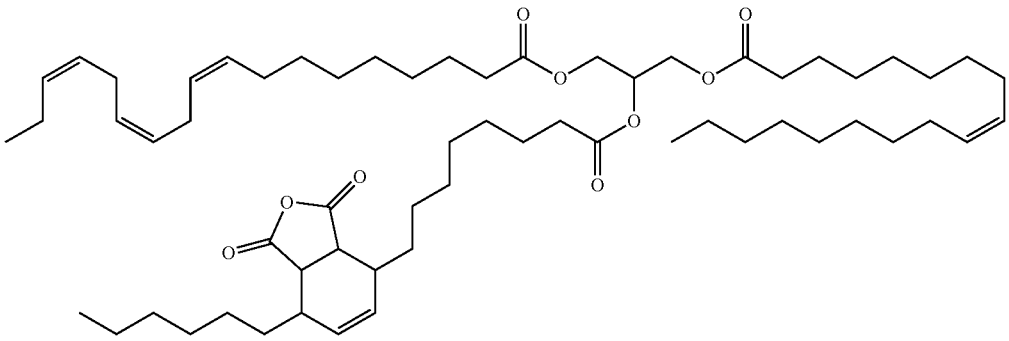

Mono-maleated Soybean Oil

-continued

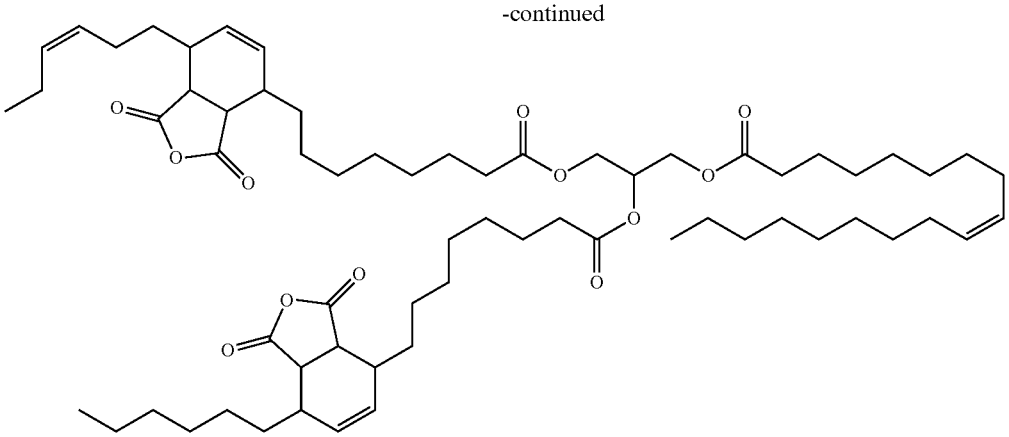

Di-maleated Soybean Oil

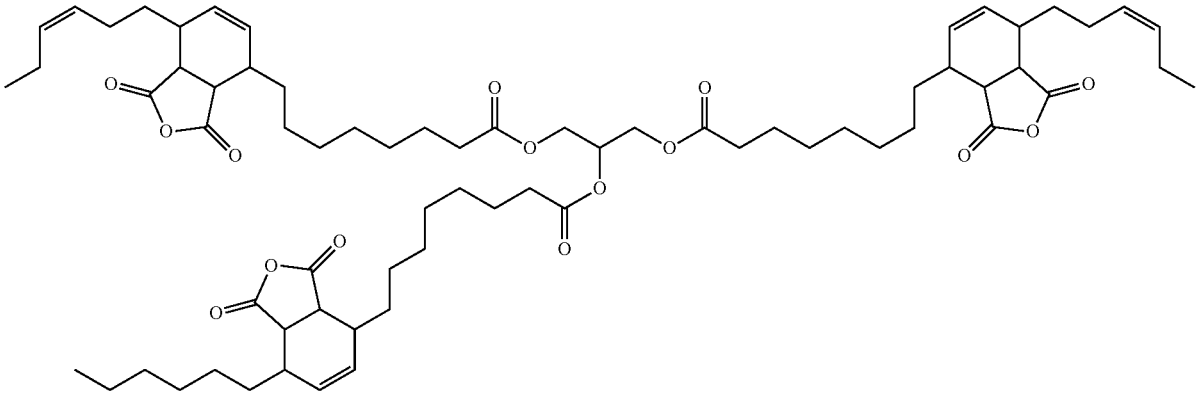

Tri-maleated Soybean Oil

Representative Species in Maleated Soybean Oil

Changes in the molar ratio of maleic anhydride to soybean oil only changes the relative proportions of these species shown above. Lower MAA:soybean oil ratios will increase the amounts of unreacted soybean oil and the mono-maleated species, whereas higher MAA:soybean oil ratios will favor the di- and tri-maleated species. It was surprisingly found, however, that the adducts produced using lower MAA:soybean oil ratios appeared to impart more lubricity when added to metalworking fluids, leading to the conclusion that the mono-maleated species are more effective, despite increasing the levels of unreacted soybean oil. Thus, the ratio of MAA:soybean oil can be adjusted to favor the production of the mono-maleated species.

Accordingly, in some embodiments, the mono-maleated polyunsaturated vegetable oil may be prepared by reacting maleic anhydride with a polyunsaturated vegetable oil in a molar ratio of maleic anhydride to polyunsaturated vegetable oil of 1:<2, 1:1.75, 1:1.5, 1:1.25, or 1:1. Higher ratios such as about 1.2:1 may also be employed.

The product of the Diels-Alder reaction is then reacted with an alcohol mixture to open the rings of the appended anhydride moieties. As such, in some embodiments, the alcohol mixture may comprise an alcohol having at least 2 carbon atoms and methoxypolyethylene glycol having a number average molecular weight ($M_n$) of at least 350. In some embodiments, the methoxypolyethylene glycol has a number average molecular weight ($M_n$) of 350 to 550. In some embodiments, the alcohol mixture comprises an alcohol that is a linear or branched $C_2$ to $C_{18}$ alcohol. In other embodiments, the alcohol may be a linear or branched $C_9$ to $C_{18}$ hydrophobic alcohol ("fatty alcohol"). In yet another embodiment, the hydrophobic alcohol may comprise at least one linear or branched $C_9$ to $C_{11}$ oxo alcohol, a linear or branched $C_{12}$ to $C_{14}$ fatty alcohol, or combinations thereof. The reaction of the mono-maleated polyunsaturated vegetable oil with the alcohol mixture may be facilitated by increasing the temperature of the reactants to 90 to 150° C. In some embodiments, the reaction temperature is at least 135° C.

In one embodiment, the molar ratio of the mono-maleated polyunsaturated vegetable oil to the alcohol mixture may range from 2:1 to 1:2. In yet another embodiment, the molar ratio may be 1:1. In one embodiment, the polyunsaturated vegetable oil used to prepare the composition may be soybean oil.

The final step of the synthetic process involves neutralization of the carboxylic acid half of the half-acid/half-ester formed by the ring-opening reaction. This carboxylic acid can be neutralized with any convenient base such that the resulting salt will be self-emulsifying in water. In one embodiment, the adduct of mono-maleated polyunsaturated vegetable oil and an alcohol mixture may be salted using an alkali metal base or an amine. In some embodiments, the adduct of mono-maleated polyunsaturated vegetable oil and an alcohol mixture may be dispersed in water and the pH may be adjusted to 8-10 with an alkali metal hydroxide or carbonate or an amine.

Suitable alkali metal bases can include, but are not limited to, sodium or potassium bases. Exemplary sodium or potassium bases are sodium hydroxide, potassium hydroxide, sodium carbonate, and potassium carbonate. Suitable amines include tertiary amines, such as tertiary alkanolamines. Exemplary tertiary alkanolamines include, but are not limited to, triethanolamine, N,N-dimethylethanolamine, N-butyldiethanolamine, N,N-diethylethanolamine, N,N-dibutylethanolamine, or mixtures thereof. In yet another embodiment, the tertiary amine may comprise triethanolamine.

Aqueous metalworking fluids prepared from an adduct of mono-maleated polyunsaturated vegetable oil and an alcohol mixture are also disclosed. The composition may be as described above. In some embodiments, the composition may be present in an amount of less than 3 wt % based on a total weight of the aqueous metalworking fluid. In some embodiments, the composition may remain uniformly dispersed in the fluid when the water has a hardness of greater than 400 ppm $CaCO_3$, based on a total weight of the fluid.

In yet other embodiments, methods of lubricating a metal component are disclosed. The methods may comprise contacting the metal component with an aqueous metalworking fluid comprising a composition prepared from an adduct of mono-maleated polyunsaturated vegetable oil and an alcohol mixture as described above. In some embodiments, the metal component may be aluminum or steel.

Methods of improving the stability and/or lubricity of a metalworking fluid by adding the composition described above to a metalworking fluid are also disclosed. In some embodiments, the composition may be present in an amount of less than 4 wt % based on a total weight of the metalworking fluid. Uses of the composition described above to improve the stability and/or lubricity of a metalworking fluid are also disclosed.

Metalworking Fluid

In one embodiment, the composition is a metalworking fluid. Typical metalworking fluid applications may include metal removal, metal forming, metal treating and metal protection. In some embodiments the metalworking fluid may comprise water and less than 4 wt % of the composition described above, based on a total weight of the metalworking fluid.

Optional additional materials may be incorporated in the metalworking fluid. Typical finished metalworking fluids may include friction modifiers, lubricity aids (in addition to the compositions described above) such as fatty acids and waxes, anti-wear agents, extreme pressure agents, dispersants, corrosion inhibitors, normal and overbased detergents, biocidal agents, metal deactivators, or mixtures thereof.

EXAMPLES

Synthesis of Maleated Soybean Oil

General procedure: Solid briquettes of maleic anhydride ("MAA") are combined with soybean oil ("SYBO") at molar ratio of 1:1 and heated directly to 200-220° C. under a slow purge of Na. Consumption of MAA is monitored by infrared spectroscopy. Consumption of MAA is indicated by disappearance of the peak at 840 $cm^{-1}$. When IR indicates MAA is consumed, the batch is cooled, yielding a dark amber, viscous liquid. No filtration or other purification is required, although sub-surface nitrogen blowing at the end of the cookout can be employed to drive out any unreacted traces of MAA. Yields are nearly quantitative. The reaction is typically complete within about 3 hours when conducted at 220° C. Holding the reaction mixture longer, up to approximately 6 hours, to ensure that trace MAA is completely consumed, does not have any deleterious effect.

The ordinarily skilled person will recognize that the reaction of the maleated soybean oil with the alcohol and methoxypolyethylene glycol may proceed directly after the maleation step and in the same reaction vessel or after an unspecified period of time and/or in a different reaction vessel.

Reaction of Maleated Soybean Oil with Alcohol and MPEG

General procedure: Maleated soybean oil, alcohol, and methoxypolyethylene glycol ("MPEG") are mixed at about 20 to 40° C. and then heated to 135° C. A slow nitrogen purge through the vapor space is maintained and the vapor is vented past a reflux condenser to minimize evaporative losses. The progress of the reaction is followed by infrared spectroscopy by monitoring disappearance of the anhydride peak at about 1780 $cm^{-1}$. When this peak stops shrinking the reaction between the alcohol, MPEG and maleated soybean oil is complete. If lower mw alcohols are used, vacuum can be applied advantageously at this point to strip out any unreacted alcohol. The products of these reactions are generally clear, moderately viscous, amber liquids. No filtration or other purification is required. Yields are usually very close to quantitative. Minor losses of volatile alcohols may occur. Various example preparations "Example Preps" are shown in Table 1 below.

TABLE 1

Example Preps

| Example | Descriptive Abbreviation (Reactants, mole ratios, conditions) |
|---|---|
| PREP 1 | SYBO + MAA 1:1, 220° C., 5.75 hr |
| PREP 2 | SYBO + MAA 1:1, 220° C., 5.7 hr |
| PREP 3 | SYBO + MAA 1:1, 220° C., 2.7 hr |
| PREP 4 | SYBO + MAA 1:1, 220° C., 3.1 hr |
| PREP 5 | SYBO + MAA 1:1, 220° C., 3.5 hr |
| PREP 6 | 1.0-MAA SYBO + MPEG 350[1] 1:1 |
| Comparative PREP 7 | 1.0-MAA SYBO + FOH-9[2] 1:1 |
| Comparative PREP 8 | 1.0-MAA SYBO + MPEG 350 + FOH-9 2:1:1 |
| PREP 9 | SYBO + MAA + MPEG 350 + FOH-9 2:2:1:1 |
| PREP 10 | 1:1 wt Blend of PREP 6 and PREP 7 |
| PREP 11 | 1.0-MAA SYBO + FOH-9 1:1 |
| PREP 12 | 1.0-MAA SYBO + MPEG 350 1:1 |
| Comparative PREP 13 | 1.0-MAA SYBO + MPEG 350 + FOH-9 2:1:1 |
| PREP 14 | 1:1 wt Blend of PREP 11 and PREP 12 |
| PREP 15 | 1.0-MAA SYBO + MPEG 450[3] + FOH-1214[4] 2:1:1 |
| PREP 16 | 1.0-MAA SYBO + TEG-Me[5] + FOH-1214 2:1:1 |
| Comp PREP 17 | 1.0-MAA SYBO + MPEG 450 + 1-Hexanol 2:1:1 |
| PREP 18 | 1.0-MAA SYBO + TEG-Me + 1-Hexanol 2:1:1 |
| Comp PREP 19 | 1.0-MAA SYBO + MPEG 350 + FOH-1214 2:1:1 |
| PREP 20 | 1.0-MAA SYBO + MPEG 350 + 1-Hexanol 2:1:1 |
| PREP 21 | 1.0-MAA SYBO + MPEG 350 + FOH-9 2:1.05:0.95 |
| PREP 22 | 1.0-MAA SYBO + MPEG 350 + FOH-9 2:0.95:1.05 |
| PREP 23 | SYBO + MAA[6] + MPEG 350 + FOH-9 2:2:1:1 |
| PREP 24 | 1.1-MAA SYBO + MPEG 350 + 2-PH[7] 2:1:1 |
| PREP 25 | 1.1-MAA SYBO + PEG 1000 + FOH-9 2:1:1 Equiv |
| Comparative PREP 26 | 1.0-MAA SYBO + TEA[8] 1:1 |
| Comparative PREP 27 | 1.0-MAA-SYBO + Ethanol + MPEG 350 2:1:1 |
| PREP 28 | 1.0-MAA-SYBO + Oleyl Alcohol + MPEG 350 2:1:1 |

[1]MPEG 350: Methoxypolyethylene glycol, 350 Mn
[2]FOH-9: $C_{9-11}$ oxo alcohol (Shell Neodol 91 Alcohol)
[3]MPEG 450: Methoxypolyethylene glycol, 450 Mn
[4]FOH-1214: $C_{12-14}$ Fatty Alcohol
[5]TEG-Me: Triethylene glycol monomethyl ether
[6]Soybean oil and malic anhydride product was not isolated prior to further reaction with the alcohol
[7]2-PH: 2-Propyl-1-heptanol
[8]TEA: Triethanolamine Each of the Example Preps above were tested in aqueous metalworking fluids for stability ("Hard Water Stability Testing") and lubricity ("Microtap Testing") performance.

Hard Water Stability Testing

Calcium and magnesium ions present as sulfates, chlorides, carbonates and bicarbonates cause water to be hard. These water-soluble divalent metal ions can complex with two moles of fatty carboxylate anion to give sticky, water-insoluble salts which separate from the aqueous metalworking fluid and can cause fouling of lines, filters and nozzles in metalworking equipment. Since the concentration of these hard water ions increases over time due to a boiler effect in metalworking equipment sumps, hard water stability, or the ability of an aqueous metalworking fluid to resist separation of sticky deposits in the presence of elevated levels of calcium and magnesium ions is a performance criterion.

Water hardness is commonly expressed as parts per million (ppm) of calcium carbonate, converting all divalent metal ions into an equal number of moles of $Ca^{2+}$ and also assuming that carbonate ($CO_3^{2-}$) is the sole counter-anion. Calcium hard water stock solutions having hardness of 200, 400, 600, 800, 1000, and 2000 ppm $CaCO_3$ were prepared by dissolving the appropriate amount of $CaCl_2.H_2O$ into deionized water.

Grains per gallon (gpg) is a unit of water hardness defined as 1 grain (64.8 milligrams) of calcium carbonate dissolved in 1 US gallon of water (3.785 L). This translates into 17.1 parts per million calcium carbonate (ppm). A mixed calcium/magnesium hard water concentrate having a nominal hardness of 800 grains per gallon was prepared by dissolving 322 grams of $CaCl_2.2H_2O$ and 111 grams of $MgCl_2.6H_2O$ in 20,000 grams of deionized water. The molar ratio of calcium to magnesium in this concentrate is 4:1. This 800 gpg concentrate was diluted back with deionized water to give mixed Ca/Mg stock solutions of 5, 10, 20, 40, and 80 gpg hardness. These mixed Ca/Mg hard water stock solutions are meant to mimic conditions commonly encountered when machining aluminum alloys, which commonly contain significant amounts of magnesium in the alloy.

Hereafter, if water hardness is expressed with units of ppm, it refers to the Calcium-only hard water stock solutions, whereas if the water hardness is expressed as grains per gallon (gpg) it refers to the mixed calcium/magnesium hard water stock solutions. A small amount of water-soluble dye is added to each hard water stock solution in order to aid visualization of any separation that occurs in the diluted metalworking fluid.

Experimental and reference metalworking fluid concentrates are dispersed into the stock solutions of hard water. These diluted mixtures are placed in 100-mL graduated cylinders and examined for separation of oil or cream on top of the fluid after standing overnight or for three days. In some cases, the dilutions are thermally stressed at 40° C. by placing the graduated cylinder in an oven during the incubation period. It is noted whether any separated oil or cream readily re-disperses with mild agitation.

Microtap Testing

For the Microtap testing, the lubricity performance of the experimental and reference aqueous metalworking fluids are evaluated in metal removal operations using the torque generated during tapping (cutting or forming threads) into pre-drilled holes. The test instrument is a TTT Tapping-Torque-Testsystem manufactured by microtap GmbH in Munich, Germany.

Microtap testing is performed on two different metal alloys, 1018 Steel and 6061 Aluminum. The steel specimens are form-tapped at 530 rpm and the aluminum specimens are form-tapped at 660 rpm. Tapping is through-hole; holes are 5 mm diameter; form taps are M6×1, 75% thread depth. A commercial semi-synthetic metalworking fluid is used as the reference fluid during each experiment in order ensure the test is performing consistently. The reference fluid is diluted to a 10 wt % treat rate for tests on 1018 alloy steel, and to 5 wt % for tests on 6061 alloy aluminum.

In order to get the most useful information for discriminating metalworking fluids from tapping torque measurements, an experimental matrix along with a statistical analysis is used. The run order of the candidate and reference fluids is randomized so that the fluid differences are not affected by where the tapping occurs on the bar. A general linear model is fit using various predictive variables. From the general linear model, the average differences of the log-transformed results between the candidate fluids and the reference fluid are estimated. The 95% confidence intervals for these average differences are obtained using a single-step, multiple comparison procedure. A bar chart with error bars is then created to show the relative efficiency of the candidate fluids to the reference fluid. The relative efficiency of a candidate fluid is defined as the ratio of the average candidate result to the average reference result.

The reference fluid is set to 100% relative efficiency for all of the ensuing tests. The relative efficiency of a candidate fluid is then calculated using the following formula.

$$\text{Relative efficiency}=(\text{torque of reference fluid})/(\text{torque of candidate fluid})\times 100\%$$

The results for the stability and lubricity testing for all of the Example Preps are summarized below.

Illustrative Results

Example 1: PREP 8-1.0-MAA SYBO+MPEG 350+FOH-9 2:1:1

The product of PREP 8 was dispersed at 1.0 wt % in water of varying Ca hardness containing 0.5 wt % TEA and dye. These aqueous dispersions were incubated at 40° C. overnight and examined for signs of separation. Water hardness levels were 0, 200, 400, 600, 800, and 1000 ppm. Cream separation of ~2 vol % was observed in the 0 ppm hardness solution, ~1 vol % at 200 and 400 ppm, and no cream separation at 600 to 1000 ppm. Cream layers easily re-dispersed. All six dilutions were tested after re-dispersion of cream layers by Microtap on 1018 Steel and 6061 Aluminum. The Microtap test results are shown in Table 2.

TABLE 2

| PREP 8 Microtap | | | | |
|---|---|---|---|---|
| 1018 Steel: | | 95% confidence | | |
| Test Fluid: | Relative Efficiency (%) | low | high | |
| Reference 10% | 100.0 | 94.3 | 106.1 | Conclusion: the product of PREP 8 |
| In 0 ppm | 102.8 | 96.8 | 109.1 | at a treat rate of 1.0 wt % when |
| In 200 ppm | 103.6 | 97.8 | 109.7 | neutralized with excess TEA |
| In 400 ppm | 103.9 | 98.0 | 110.1 | performed as well as the reference |
| In 600 ppm | 100.4 | 94.6 | 106.6 | fluid at 10 wt % when tapping steel |
| In 800 ppm | 104.5 | 98.5 | 110.7 | at all tested levels of water |
| In 1000 ppm | 105.4 | 99.2 | 112.0 | hardness. |

TABLE 2-continued

| PREP 8 Microtap | | | | |
|---|---|---|---|---|
| 6061 Aluminum: | | 95% confidence | | |
| Test Fluid: | Relative Efficiency (%) | low | high | |
| Reference 5% | 100.0 | 96.9 | 103.2 | Conclusion: the product of PREP 8 |
| In 0 ppm | 136.5 | 132.2 | 141.0 | at a treat rate of 1.0 wt % when |
| In 200 ppm | 114.3 | 110.8 | 117.8 | neutralized with excess TEA |
| In 400 ppm | 143.7 | 139.2 | 148.2 | performed significantly better than |
| In 600 ppm | 142.0 | 137.6 | 146.6 | the reference fluid at 5 wt % when |
| In 800 ppm | 139.1 | 134.9 | 143.5 | tapping aluminum at all tested |
| In 1000 ppm | 136.8 | 132.5 | 141.3 | levels of water hardness. |

Example 2: PREP 8-1.0-MAA SYBO+MPEG 350+FOH-9 2:1:1

The product of PREP 8 was dispersed at 1.0 wt % in deionized water containing 0.5 wt % of five different tertiary amines. These aqueous dispersions were placed in Casio flasks and incubated at 40° C. overnight and examined for signs of separation.

| | | | |
|---|---|---|---|
| A. | Triethanolamine (TEA) | 2.7% | cream separation |
| B. | N,N-Dimethylethanolamine (DMEA) | 0.6% | cream |
| C. | N-Butyldiethanolamine (BDELA) | 0.5% | cream |
| D. | N,N-Diethylethanolamine (DEEA) | 0.4% | cream |
| E. | N,N-Dibutylethanolamine (DBEA) | 0.4% | cream |

The cream layers all easily re-dispersed. All five dilutions were tested by Microtap on 1018 Steel and 6061 Aluminum after re-dispersion of cream layers. The Microtap test results are shown in Table 3.

Example 3: PREP 8-1.0-MAA SYBO+MPEG 350+FOH-9 2:1:1

The product of PREP 8 was dispersed at 1.0 wt % in tap water (~115 ppm hardness) containing 0.5 wt % TEA and dye. 700 grams of this blend was prepared. This blend was placed in a 40° C. oven and left to incubate. Samples were taken at various times and tested on the Microtap.

| | |
|---|---|
| A. | 0 days (sample before placing in oven) |
| B. | 1 day at 40° C. |
| C. | 4 days at 40° C. |
| D. | 8 days at 40° C. |

A small amount of bottom dropout was noted as the sample heat-aged. This dropout easily re-suspended with mild agitation. The master sample was shaken before taking the samples B-D. The reference fluid was not incubated. The results for PREP 8 after incubation are shown in Table 4 below.

TABLE 3

| PREP 8 Microtap with different tertiary amines | | | | |
|---|---|---|---|---|
| 1018 Steel: | | 95% confidence | | |
| Test Fluid: | Relative Efficiency (%) | low | high | |
| Ref 10% | 100.0 | 97.0 | 103.1 | Conclusion: the product of PREP |
| A. TEA | 107.1 | 103.8 | 110.5 | 8 at a treat rate of 1.0 wt % |
| B. DMEA | 91.1 | 88.3 | 93.9 | performed better than the |
| C. BDELA | 90.1 | 87.4 | 92.9 | reference fluid at 10 wt % when |
| D. DEEA | 85.7 | 83.1 | 88.4 | neutralized with TEA, and |
| E. DBEA | 97.6 | 94.6 | 100.6 | comparable to the reference fluid when neutralized with DBEA. Although Microtap lubricity on steel was inferior to the reference fluid when neutralized with DMEA, BDELA, and DEEA, the treat rates were significantly lower. |
| 6061 Aluminum: | | 95% confidence | | |
| Test Fluid: | Relative Efficiency (%) | low | high | |
| Ref 5% | 100.0 | 97.2 | 102.9 | Conclusion: the product of PREP |
| A. TEA | 140.1 | 136.1 | 144.2 | 8 at a treat rate of 1.0 wt % when |
| B. DMEA | 69.0 | 67.1 | 71.0 | neutralized with excess TEA |
| C. BDELA | 79.8 | 77.6 | 82.1 | performed significantly better |
| D. DEEA | 69.1 | 67.1 | 71.0 | than the reference fluid at 5 wt % |
| E. DBEA | 84.9 | 82.5 | 87.3 | when tapping aluminum. Although the other tertiary amine salts did not perform as well as the reference fluid, the treat rates were significantly lower. |

TABLE 4

| PREP 8 after incubation | | | | |
|---|---|---|---|---|
| 1018 Steel: | | 95% confidence | | |
| Test Fluid: | Relative Efficiency (%) | low | high | |
| Reference, 10% | 100.0 | 97.7 | 102.4 | Conclusion: The performance of the product of PREP 8 at a treat rate of 1.0 wt % when neutralized with excess TEA on steel declined moderately over time when held at 40° C. |
| A. 0 days at 40 C. | 95.1 | 92.8 | 97.4 | |
| B. 1 day at 40 C. | 94.3 | 92.2 | 96.5 | |
| C. 4 days at 40 C. | 91.3 | 89.2 | 93.5 | |
| D. 8 days at 40 C. | 91.9 | 89.8 | 94.1 | |
| 6061 Aluminum: | | 95% confidence | | |
| Test Fluid: | Relative Efficiency (%) | low | high | |
| Reference, 5% | 100.0 | 97.8 | 102.3 | Conclusion: The performance of the product of PREP 8 at a treat rate of 1.0 wt % when neutralized with excess TEA on aluminum improved moderately over time when held at 40° C. |
| A. 0 days at 40 C. | 95.7 | 93.5 | 98.0 | |
| B. 1 day at 40 C. | 96.5 | 94.4 | 98.6 | |
| C. 4 days at 40 C. | 102.2 | 100.0 | 104.6 | |
| D. 8 days at 40 C. | 106.4 | 104.0 | 108.8 | |

Example 4: PREP 9-SYBO+MAA+MPEG 350+FOH-9 2:2:1:1

PREP 9 demonstrates a process where the maleated soybean oil is not isolated prior to reaction with the alcohol and MPEG. The product of PREP 9 was dispersed at 1.0 wt % in water of varying hardness containing 0.25 wt % TEA, 0.20 w % N,N-methylenebismorpholine (a biocide), and dye. Water hardness levels were as in Example 1. These aqueous dispersions were left at room temperature overnight and examined for signs of separation. Cream separation was essentially the same as in Example 1. Cream layers easily re-dispersed. All six dilutions were tested by Microtap on 1018 Steel and 6061 Aluminum after re-dispersion of cream layers. The Microtap test results are shown in Table 5.

TABLE 5

| PREP 9 Microtap Results | | | | |
|---|---|---|---|---|
| 1018 Steel: | | 95% confidence | | |
| Test Fluid: | Relative Efficiency (%) | low | high | |
| Reference 10% | 100.0 | 94.9 | 105.4 | Conclusion: the product of PREP 9 at a treat rate of 1.0 wt % when neutralized with excess TEA and top-treated with a water-soluble amine-based biocide performed significantly better than the reference fluid at 10 wt % when tapping steel at all tested levels of water hardness. |
| In 0 ppm | 108.3 | 102.7 | 114.2 | |
| In 200 ppm | 118.5 | 112.7 | 124.7 | |
| In 400 ppm | 120.9 | 114.8 | 127.3 | |
| In 600 ppm | 123.2 | 116.9 | 129.9 | |
| In 800 ppm | 121.7 | 115.6 | 128.1 | |
| In 1000 ppm | 123.2 | 116.8 | 130.0 | |
| 6061 Aluminum: | | 95% confidence | | |
| Test Fluid: | Relative Efficiency (%) | low | high | |
| Reference 5% | 100.0 | 93.0 | 107.6 | Conclusion: the product of PREP 9 at a treat rate of 1.0 wt % when neutralized with excess TEA and top-treated with a water-soluble amine-based biocide performed significantly better than the reference fluid at 5 wt % when tapping aluminum at all tested levels of water hardness |
| In 0 ppm | 113.1 | 105.0 | 121.8 | |
| In 200 ppm | 118.7 | 110.6 | 127.4 | |
| In 400 ppm | 106.7 | 99.2 | 114.7 | |
| In 600 ppm | 162.0 | 150.5 | 174.3 | |
| In 800 ppm | 190.3 | 177.1 | 204.5 | |
| In 1000 ppm | 185.2 | 171.9 | 199.6 | |

Example 5: PREP 10-1:1 wt Blend of PREP 6 and PREP 7

The products of PREP 6 and PREP 7 were blended together at a 1:1 wt ratio to produce PREP 10. This blend was dispersed at 1.0 wt % in water of varying hardness containing 0.5 wt % TEA and dye. Water hardness levels were as in Example 1. These aqueous dispersions were incubated at 40° C. overnight and examined for signs of separation. The reference fluid was not incubated. Cream separation was less than 0.5 vol % in 0 ppm and 200 ppm hardness. There was no cream separation at higher hardness levels. Cream layers easily re-dispersed. PREP 10 exhibits less cream separation than the analogous "reacted" product PREP 8. All dilutions were tested by Microtap on 1018 Steel and 6061 Aluminum after re-dispersion of cream layers. The Microtap results of PREP 10 are shown in Table 6.

TABLE 6

PREP 10 Microtap Results

| 1018 Steel: | | 95% confidence | | |
|---|---|---|---|---|
| Test Fluid: | Relative Efficiency (%) | low | high | |
| Reference 10% | 100.0 | 95.6 | 104.6 | Conclusion: PREP 10 at a |
| In 0 ppm | 101.6 | 97.1 | 106.3 | treat rate of 1.0 wt % when |
| In 200 ppm | 123.1 | 117.9 | 128.6 | neutralized with excess TEA |
| In 400 ppm | 113.4 | 108.3 | 118.8 | performed significantly |
| In 600 ppm | 117.3 | 112.1 | 122.7 | better than the reference |
| In 800 ppm | 115.2 | 110.3 | 120.4 | fluid at 10 wt % at water |
| In 1000 ppm | 116.9 | 111.7 | 122.3 | hardness levels of 200 ppm and higher. |
| **6061 Aluminum:** | | **95% confidence** | | |
| Test Fluid: | Relative Efficiency (%) | low | high | |
| Reference 5% | 100.0 | 96.7 | 103.4 | Conclusion: PREP 10 at a |
| In 0 ppm | 106.6 | 103.0 | 110.3 | treat rate of 1.0 wt % when |
| In 200 ppm | 151.0 | 146.1 | 156.0 | neutralized with excess TEA |
| In 400 ppm | 143.1 | 138.2 | 148.2 | performed significantly |
| In 600 ppm | 144.5 | 139.7 | 149.6 | better than the reference |
| In 800 ppm | 138.4 | 133.8 | 143.0 | fluid at 5 wt % at all tested |
| In 1000 ppm | 133.7 | 129.2 | 138.3 | water hardness levels. |

Example 6: PREP 10-1:1 wt Blend of PREP 6 and PREP 7

This is a repeat of Example 5 with more stressed conditions. An additional water hardness level of 2000 ppm was added and the 40° C. incubation period was increased to three days. The reference fluid was not incubated. Cream separation was less than 0.5 vol % in 0 ppm and 200 ppm hardness. There was little to no cream separation at hardness levels of 400-1000 ppm. There was about 1 vol % cream separation at 2000 ppm hardness. Cream layers easily re-dispersed. All six dilutions were tested by Microtap on 1018 Steel and 6061 Aluminum after re-dispersion of cream layers. The results are shown in Table 7 below.

TABLE 7

PREP 10 after 3-day incubation period

| 1018 Steel: | | 95% confidence | | |
|---|---|---|---|---|
| Test Fluid: | Relative Efficiency (%) | low | high | |
| Reference 10% | 100.0 | 92.7 | 107.9 | Conclusion: PREP 10 at a |
| In 0 ppm | 102.3 | 94.7 | 110.5 | treat rate of 1.0 wt % when |
| In 200 ppm | 122.7 | 114.0 | 132.0 | neutralized with excess TEA |
| In 400 ppm | 115.2 | 106.5 | 124.6 | performed significantly |
| In 600 ppm | 117.5 | 108.9 | 126.9 | better than the reference |
| In 800 ppm | 114.2 | 106.0 | 123.1 | fluid at 10 wt % at water |
| In 1000 ppm | 112.9 | 104.5 | 121.9 | hardness levels of 200 ppm |
| In 2000 ppm | 112.5 | 104.3 | 121.3 | and higher. |

TABLE 7-continued

| PREP 10 after 3-day incubation period | | | | |
|---|---|---|---|---|
| 6061 Aluminum: | | 95% confidence | | |
| Test Fluid: | Relative Efficiency (%) | low | high | |
| Reference 5% | 100.0 | 95.6 | 104.6 | Conclusion: PREP 10 at a |
| In 0 ppm | 103.0 | 98.4 | 107.8 | treat rate of 1.0 wt % when |
| In 200 ppm | 148.4 | 142.1 | 154.9 | neutralized with excess TEA |
| In 400 ppm | 143.0 | 136.5 | 149.8 | performed significantly |
| In 600 ppm | 144.7 | 138.3 | 151.3 | better than the reference |
| In 800 ppm | 137.3 | 131.4 | 143.4 | fluid at 5 wt % at all tested |
| In 1000 ppm | 129.5 | 123.7 | 135.5 | water hardness levels of 200 |
| In 2000 ppm | 116.0 | 111.0 | 121.3 | ppm and higher. |

Example 7: Comparison of PREP 13-1.0-MAA SYBO+MPEG 350+FOH-9 2:1:1 and PREP 14-1:1 wt Blend of PREP 11 and PREP 12

The products of PREP 13 and PREP 14 are compared side-by-side at a level of 1 wt % in 0 ppm, 400 ppm and 1000 ppm hardness water containing 0.5 wt % TEA and dye. These aqueous dispersions were incubated at 40° C. overnight and examined for signs of separation. The reference fluid was not incubated. The PREP 13 dispersions exhibited more cream separation than the PREP 14 dispersions. The PREP 14 dispersions also had a more milky appearance. Cream layers easily re-dispersed. All six dilutions were tested by Microtap on 1018 Steel and 6061 Aluminum after re-dispersion of cream layers, and the results are shown in Table 8 below.

TABLE 8

| Comparison of PREP 13 and PREP 14 | | | | |
|---|---|---|---|---|
| 1018 Steel: | | 95% confidence | | |
| Test Fluid: | Relative Efficiency (%) | low | high | |
| Reference 10% | 100.0 | 95.9 | 104.3 | Conclusion: Blended product |
| PREP 14 in 0 ppm | 115.7 | 110.9 | 120.8 | PREP 14 outperformed |
| PREP 13 in 0 ppm | 113.7 | 109.2 | 118.4 | the reacted product PREP |
| PREP 14 in 400 ppm | 113.3 | 108.7 | 118.1 | 13 at all tested water |
| PREP 13 in 400 ppm | 105.4 | 101.1 | 110.0 | hardness levels. |
| PREP 14 in 800 ppm | 119.2 | 114.4 | 124.2 | Both products outperformed |
| PREP 13 in 800 ppm | 111.3 | 106.6 | 116.1 | the reference fluid. |
| 6061 Aluminum: | | 95% confidence | | |
| Test Fluid: | Relative Efficiency (%) | low | high | |
| Reference 5% | 100.0 | 96.9 | 103.2 | Conclusion: Blended product |
| PREP 14 in 0 ppm | 119.6 | 115.9 | 123.4 | PREP 14 outperformed |
| PREP 13 in 0 ppm | 97.7 | 94.8 | 100.6 | the reacted product PREP |
| PREP 14 in 400 ppm | 134.7 | 130.6 | 138.9 | 13 at 0 and 800 ppm water |
| PREP 13 in 400 ppm | 134.9 | 130.7 | 139.2 | hardness levels. Both |
| PREP 14 in 800 ppm | 138.7 | 134.6 | 143.1 | products outperformed the |
| PREP 13 in 800 ppm | 133.2 | 129.0 | 137.5 | reference fluid at all hardness levels, except PREP 13 at 0 ppm hardness, which had comparable performance to the reference fluid. |

Example 8: PREP 15-1.0-MAA SYBO+MPEG 450+FOH-1214 2:1:1

PREP 15 was dispersed at 1.0 wt % in water of varying hardness up to 2000 ppm containing 0.5 wt % TEA and dye. These aqueous dispersions were incubated overnight at 40° C. and examined for signs of separation. The reference fluid was not incubated. There was little to no cream separation at hardness levels of 400-2000 ppm. There was about 2 vol % cream separation in distilled water and 1 vol % in 200 ppm hardness water. Cream layers easily re-dispersed. All seven dilutions were tested after re-dispersion of cream layers by Microtap on 1018 Steel and 6061 Aluminum and are shown in Table 9 below.

TABLE 9

| PREP 15 Microtap Results. | | | | |
|---|---|---|---|---|
| 1018 Steel: | | 95% confidence | | |
| Test Fluid: | Relative Efficiency (%) | low | high | |
| Reference 10% | 100.0 | 94.2 | 106.2 | Conclusion: PREP 15 at a |
| In 0 ppm | 110.7 | 104.2 | 117.6 | treat rate of 1.0 wt % when |
| In 200 ppm | 114.0 | 107.6 | 120.8 | neutralized with excess TEA |
| In 400 ppm | 115.5 | 108.6 | 122.8 | performed significantly |
| In 600 ppm | 113.8 | 107.2 | 120.8 | better than the reference |
| In 800 ppm | 111.9 | 105.6 | 118.7 | fluid at 10 wt % at all tested |
| In 1000 ppm | 117.2 | 110.3 | 124.5 | hardness levels. |
| In 2000 ppm | 119.4 | 112.5 | 126.6 | |
| 6061 Aluminum: | | 95% confidence | | |
| Test Fluid: | Relative Efficiency (%) | low | high | |
| Reference 5% | 100.0 | 95.6 | 104.6 | Conclusion: PREP 15 at a |
| In 0 ppm | 86.1 | 82.3 | 90.1 | treat rate of 1.0 wt % when |
| In 200 ppm | 122.1 | 116.9 | 127.4 | neutralized with excess TEA |
| In 400 ppm | 135.6 | 129.5 | 142.0 | performed significantly |
| In 600 ppm | 135.5 | 129.6 | 141.8 | better than the reference |
| In 800 ppm | 131.2 | 125.6 | 137.1 | fluid at 10 wt % at hardness |
| In 1000 ppm | 136.2 | 130.2 | 142.5 | levels of 200 ppm and |
| In 2000 ppm | 128.1 | 122.6 | 133.9 | higher. |

Comparative Example 9: PREP 16-1.0-MAA SYBO+TEG-Me+FOH-1214 2:1:1

PREP 16 (Comparison) was dispersed at 1.0 wt % in water of varying hardness up to 2000 ppm containing 0.5 wt % TEA and dye. These aqueous dispersions were incubated overnight at 40° C. and examined for signs of separation. Significant separation of an oil layer was observed in the dilutions above 200 ppm hardness. No Microtap testing was done due to the oil separation. The conclusion is that triethylene glycol monomethyl ether, having a molecular weight of 164.2, is too short to provide the needed hard water stability.

Example 10: PREP 17-1.0-MAA SYBO+MPEG 450+1-Hexanol 2:1:1

PREP 17 was tested as per Example 8. Cream separation was ~2 vol % in 0 hardness water, ~1 vol % in 200 ppm hardness, and trace cream was observed at 400-2000 ppm. Cream layers easily re-dispersed. All seven dilutions were tested by Microtap on 1018 Steel and 6061 Aluminum after re-dispersion of cream layers. Microtap results for PREP 17 are shown in Table 10.

TABLE 10

| 1018 Steel: | | 95% confidence | | |
|---|---|---|---|---|
| Test Fluid: | Relative Efficiency (%) | low | high | |
| Reference 10% | 100.0 | 94.9 | 105.4 | Conclusion: PREP 17 at a |
| In 0 ppm | 106.9 | 101.4 | 112.7 | treat rate of 1.0 wt % when |
| In 200 ppm | 113.3 | 107.8 | 119.2 | neutralized with excess |
| In 400 ppm | 117.4 | 111.2 | 123.9 | TEA performed |
| In 600 ppm | 116.7 | 110.7 | 123.0 | significantly better than the |
| In 800 ppm | 121.0 | 115.0 | 127.4 | reference fluid at 10 wt % at |
| In 1000 ppm | 119.9 | 113.7 | 126.4 | all tested hardness levels. |
| In 2000 ppm | 121.8 | 115.6 | 128.2 | |
| 6061 Aluminum: | | 95% confidence | | |
| Test Fluid: | Relative Efficiency (%) | low | high | |
| Reference 5% | 100.0 | 96.5 | 103.7 | Conclusion: PREP 17 at a |
| In 0 ppm | 81.6 | 78.7 | 84.6 | treat rate of 1.0 wt % when |
| In 200 ppm | 117.8 | 113.8 | 121.9 | neutralized with excess |
| In 400 ppm | 126.0 | 121.4 | 130.8 | TEA performed |
| In 600 ppm | 138.9 | 134.0 | 144.0 | significantly better than the |
| In 800 ppm | 132.0 | 127.5 | 136.8 | reference fluid at 5 wt % at |
| In 1000 ppm | 142.4 | 137.3 | 147.6 | all tested water hardness |
| In 2000 ppm | 130.7 | 126.1 | 135.4 | levels of 200 ppm and higher. |

Comparative Example 11: PREP 18-1.0-MAA SYBO+TEG-Me+1-Hexanol 2:1:1

PREP 18 was dispersed at 1.0 wt % in water of varying hardness up to 2000 ppm containing 0.5 wt % TEA and dye. These aqueous dispersions were incubated overnight at 40° C. and examined for signs of separation. Significant separation of an oil layer was observed in all of the dilutions; oil separation was especially severe above 600 ppm hardness. No Microtap testing was done due to the oil separation. The conclusion (along with Example 9) is that triethylene glycol monomethyl ether is too short to provide the needed hard water stability.

Example 12: PREPS 13, 19, and 20

This is a side-by-side comparison of three related materials, differing only the number of carbons in the alcohol portion.

PREP 13=1.0-MAA SYBO+MPEG 350+FOH-9 2:1:1

PREP 19=1.0-MAA SYBO+MPEG 350+FOH-1214 2:1:1

PREP 20=1.0-MAA SYBO+MPEG 350+1-Hexanol 2:1:1

These samples were dispersed in 0 ppm, 400 ppm, and 800 ppm hard water with 0.5 wt % TEA and dye. The aqueous dispersions were incubated for three days at 40° C. and examined for signs of separation. The cream layers in all samples easily re-dispersed with a single inversion of the graduated cylinder. The stability results for the above fluids are shown in Table 11 below.

TABLE 11

| Cream Separation, volume % | | | | |
|---|---|---|---|---|
| Test Fluid: | 0 ppm | 400 ppm | 800 ppm | |
| PREP 13 | 4 | 2 | 10 | Conclusion: PREP 19 gave the least cream separation. |
| PREP 19 | 4 | trace | 8 | |
| PREP 20 | 4 | 0 | 20 | |

All samples were tested by Microtap lubricity evaluation on 1018 steel and 6061 aluminum after re-dispersion of cream. Results are shown in Table 12 below.

TABLE 12

| 1018 Steel: | | 95% confidence | | |
|---|---|---|---|---|
| Test Fluid: | Relative Efficiency (%) | low | high | |
| Reference 10% | 100.0 | 95.2 | 105.1 | Conclusion: Differences in the Microtap lubricity performance between PREP 13, PREP 19, and PREP 20 on steel were minor. |
| PREP 13, 0 ppm | 125.3 | 119.2 | 131.7 | |
| PREP 19, 0 ppm | 125.1 | 119.3 | 131.2 | |
| PREP 20, 0 ppm | 118.8 | 112.9 | 125.0 | |
| PREP 13, 400 ppm | 113.6 | 108.2 | 119.4 | |
| PREP 19, 400 ppm | 111.3 | 106.0 | 116.8 | |
| PREP 20, 400 ppm | 113.3 | 107.8 | 119.1 | |
| PREP 13, 800 ppm | 122.5 | 116.7 | 128.6 | |
| PREP 19, 800 ppm | 119.1 | 113.3 | 125.2 | |
| PREP 20, 800 ppm | 119.9 | 114.0 | 126.0 | |
| **6061 Aluminum** | | **95% confidence** | | |
| Test Fluid: | Relative Efficiency (%) | low | high | |
| Reference 10% | 100.0 | 95.8 | 104.4 | Conclusion: PREP 19 gave the best overall performance on aluminum. |
| PREP 13, 0 ppm | 127.5 | 122.0 | 133.2 | |
| PREP 19, 0 ppm | 150.5 | 144.4 | 156.9 | |
| PREP 20, 0 ppm | 103.4 | 98.9 | 108.1 | |
| PREP 13, 400 ppm | 157.9 | 151.2 | 164.9 | |
| PREP 19, 400 ppm | 158.0 | 151.4 | 164.8 | |
| PREP 20, 400 ppm | 138.6 | 132.7 | 144.8 | |
| PREP 13, 800 ppm | 149.1 | 142.9 | 155.6 | |
| PREP 19, 800 ppm | 147.6 | 141.4 | 154.2 | |
| PREP 20, 800 ppm | 139.9 | 133.9 | 146.2 | |

Example 13: PREPS 13, 19, and 20

This is similar to Example 12 with the exception that the fluids were not thermally stressed. These samples were dispersed in 0 ppm, 400 ppm, and 800 ppm hard water with 0.5 wt % TEA and dye. The aqueous dispersions were incubated overnight at room temperature and examined for signs of separation. The cream layers in all samples easily re-dispersed with a single inversion of the graduated cylinder. The stability results are shown in Table 13 below.

TABLE 13

| Cream Separation, volume % | | | | |
|---|---|---|---|---|
| Test Fluid: | 0 ppm | 400 ppm | 800 ppm | |
| PREP 13 | 4 | 0 | 0 | Conclusion: Cream separation was similar for all three materials. Cream separation was significantly less in the hard water dilutions than in Example 12. |
| PREP 19 | 3.5 | 0 | 0 | |
| PREP 20 | 3 | 0 | 0 | |

All samples were tested by Microtap evaluation on 1018 steel and 6061 aluminum after re-dispersion. The results are shown in Table 14 below.

TABLE 14

| 1018 Steel: | | 95% confidence | | |
|---|---|---|---|---|
| Test Fluid: | Relative Efficiency (%) | low | high | |
| Reference 10% | 100.0 | 94.9 | 105.3 | Conclusion: There were no significant differences between these three materials on steel. |
| PREP 13, 0 ppm | 122.3 | 116.1 | 129.0 | |
| PREP 19, 0 ppm | 124.4 | 118.4 | 130.8 | |
| PREP 20, 0 ppm | 117.8 | 111.7 | 124.2 | |
| PREP 13, 400 ppm | 114.3 | 108.5 | 120.4 | |
| PREP 19, 400 ppm | 112.9 | 107.3 | 118.8 | |
| PREP 20, 400 ppm | 113.3 | 107.5 | 119.4 | |
| PREP 13, 800 ppm | 119.3 | 113.4 | 125.6 | |
| PREP 19, 800 ppm | 115.6 | 109.7 | 121.8 | |
| PREP 20, 800 ppm | 116.6 | 110.7 | 122.9 | |
| 6061 Aluminum | | 95% confidence | | |
| Test Fluid: | Relative Efficiency (%) | low | high | |
| Reference 10% | 100.0 | 96.7 | 103.4 | Conclusion: PREP 19 gave the best overall performance on aluminum and PREP 20 was the worst overall in this group on aluminum. |
| PREP 13, 0 ppm | 127.4 | 123.1 | 131.9 | |
| PREP 19, 0 ppm | 149.7 | 144.9 | 154.6 | |
| PREP 20, 0 ppm | 104.1 | 100.5 | 107.8 | |
| PREP 13, 400 ppm | 147.1 | 142.2 | 152.1 | |
| PREP 19, 400 ppm | 154.3 | 149.2 | 159.5 | |
| PREP 20, 400 ppm | 134.8 | 130.3 | 139.5 | |
| PREP 13, 800 ppm | 154.4 | 149.4 | 159.6 | |
| PREP 19, 800 ppm | 151.4 | 146.3 | 156.7 | |
| PREP 20, 800 ppm | 140.7 | 136.0 | 145.7 | |

Example 14: PREP 21-1.0-MAA SYBO+MPEG 350+FOH-9 2:1.05:0.95

For the stability and lubricity tests on PREP 21, mixed Ca/Mg hard water of 80, 40, 20, 10, and 5-grain hardness along with de-ionized ("DI") water was used in this example. PREP 21 was diluted at 1 wt % with 0.5 wt % TEA in each of these hardnesses and the dilutions were incubated in a 40° C. oven overnight and inspected for signs of separation. There was ~2 vol % cream in DI water, ~1 vol % in 5 gpg, trace cream at 10 gpg, and ~6 vol % cream at 80 gpg. Cream layers easily re-dispersed. All six dilutions were tested by Microtap on 1018 Steel and 6061 Aluminum after re-dispersion of cream layers. The Microtap results are shown in Table 15 below.

TABLE 15

| 1018 Steel: | | 95% confidence | | |
|---|---|---|---|---|
| Test Fluid: | Relative Efficiency (%) | low | high | |
| Reference 10% | 100.0 | 97.0 | 103.1 | Conclusion: PREP 21 gave better lubricity than the reference fluid at all hardnesses on steel. |
| In 0 gpg | 107.7 | 104.3 | 111.3 | |
| In 5 gpg | 109.5 | 106.3 | 112.8 | |
| In 10 gpg | 104.9 | 101.8 | 108.1 | |
| In 20 gpg | 102.6 | 99.5 | 105.9 | |
| In 40 gpg | 109.2 | 106.0 | 112.6 | |
| In 80 gpg | 112.3 | 108.8 | 115.9 | |
| 6061 Aluminum: | | 95% confidence | | |
| Test Fluid: | Relative Efficiency (%) | low | high | |
| Reference 5% | 100.0 | 97.1 | 103.0 | Conclusion: PREP 21 gave markedly better lubricity than the reference fluid at all hardnesses on aluminum. Lubricity generally improved with increasing hardness. |
| In 0 gpg | 134.9 | 131.0 | 139.0 | |
| In 5 gpg | 122.4 | 119.0 | 125.9 | |
| In 10 gpg | 123.3 | 119.8 | 127.0 | |
| In 20 gpg | 144.5 | 140.2 | 148.8 | |
| In 40 gpg | 153.5 | 149.1 | 158.0 | |
| In 80 gpg | 150.3 | 145.8 | 154.9 | |

Example 15: PREP 22-1.0-MAA SYBO+MPEG 350+FOH-9 2:0.95:1.05

PREP 22 was used to make the samples for Example 15. The dilutions and thermal stressing were as described in Example 14. There was ~2 vol % cream in DI water, ~1 vol % in 5 gpg, trace cream at 10 gpg, and ~2 vol % cream at 80 gpg. Cream layers easily re-dispersed. All six dilutions were tested by Microtap on 1018 Steel and 6061 Aluminum after re-dispersion of cream. The results are shown in Table 16 below.

TABLE 16

| 1018 Steel: | | 95% confidence | | |
|---|---|---|---|---|
| Test Fluid: | Relative Efficiency (%) | low | high | |
| Reference 10% | 100.0 | 97.5 | 102.5 | Conclusion: PREP 21 and PREP 22 give essentially the same Microtap results on steel. |
| In 0 gpg | 112.0 | 109.2 | 114.9 | |
| In 5 gpg | 108.8 | 106.2 | 111.5 | |
| In 10 gpg | 105.9 | 103.3 | 108.6 | |
| In 20 gpg | 103.3 | 100.8 | 106.0 | |
| In 40 gpg | 108.2 | 105.6 | 110.9 | |
| In 80 gpg | 109.9 | 107.2 | 112.8 | |
| **6061 Aluminum:** | | **95% confidence** | | |
| Test Fluid: | Relative Efficiency (%) | low | high | |
| Reference 5% | 100.0 | 95.1 | 105.1 | Conclusion: PREP 22 gave better performance than PREP 21 on the aluminum Microtap testing in the lower hardness dilutions. |
| In 0 gpg | 164.3 | 156.2 | 172.9 | |
| In 5 gpg | 142.9 | 136.1 | 150.0 | |
| In 10 gpg | 136.1 | 129.6 | 143.0 | |
| In 20 gpg | 146.4 | 139.2 | 154.0 | |
| In 40 gpg | 153.9 | 146.4 | 161.6 | |
| In 80 gpg | 134.1 | 127.4 | 141.1 | |

Example 16: PREP 23-SYBO+MAA+MPEG 350+FOH-9 2:2:1:1

PREP 23 is a "one pot" example where the maleated soybean oil is carried on directly into the reaction with methoxypolyethylene glycol and fatty alcohol without prior isolation. For PREP 23, the dilutions and thermal stressing were as described in Example 14. Cream separation in the dilutions was virtually indistinguishable from that seen in Example 15. Cream layers easily re-dispersed. All six dilutions were tested by Microtap on 1018 Steel and 6061 Aluminum after re-dispersing cream. The results are shown in Table 17 below.

TABLE 17

| 1018 Steel: | | 95% confidence | | |
|---|---|---|---|---|
| Test Fluid: | Relative Efficiency (%) | low | high | |
| Reference 10% | 100.0 | 96.0 | 104.1 | Conclusion: PREP 23 gives good lubricity in the mixed Ca/Mg hard water on steel. |
| In 0 gpg | 111.8 | 107.2 | 116.5 | |
| In 5 gpg | 110.2 | 106.0 | 114.6 | |
| In 10 gpg | 110.6 | 106.2 | 115.1 | |
| In 20 gpg | 98.7 | 94.7 | 102.8 | |
| In 40 gpg | 103.4 | 99.4 | 107.7 | |
| In 80 gpg | 105.1 | 100.8 | 109.6 | |
| **6061 Aluminum:** | | **95% confidence** | | |
| Test Fluid: | Relative Efficiency (%) | low | high | |
| Reference 5% | 100.0 | 96.8 | 103.3 | Conclusion: PREP 23 gives very good lubricity in the mixed Ca/Mg hard water on aluminum. |
| In 0 gpg | 162.4 | 157.0 | 167.9 | |
| In 5 gpg | 141.2 | 136.7 | 145.7 | |
| In 10 gpg | 139.5 | 135.0 | 144.1 | |
| In 20 gpg | 149.7 | 144.8 | 154.8 | |
| In 40 gpg | 148.2 | 143.5 | 153.1 | |
| In 80 gpg | 114.3 | 110.5 | 118.2 | |

Example 17: PREP 24-1.1-MAA SYBO+MPEG 350+2-PH (2:1:1)

PREP 24 uses a branched alcohol (2-propylheptanol) in the alcohol mixture. Dilutions and thermal stressing were as described in Example 14. Cream separation in the dilutions was essentially the same as seen in Example 15 except that there was no cream in the 80 gpg dilution. Cream layers easily re-dispersed in all cases. All six dilutions were tested by Microtap on 1018 Steel and 6061 Aluminum. The results are shown in Table 18 below.

TABLE 18

| 1018 Steel: | | 95% confidence | | |
|---|---|---|---|---|
| Test Fluid: | Relative Efficiency (%) | low | high | |
| Reference 10% | 100.0 | 96.1 | 104.0 | Conclusion: Results in the Ca/Mg mixed hard water were similar to PREP 23 on steel. |
| In 0 gpg | 109.8 | 105.5 | 114.3 | |
| In 5 gpg | 108.7 | 104.7 | 113.0 | |
| In 10 gpg | 106.2 | 102.1 | 110.4 | |
| In 20 gpg | 103.6 | 99.5 | 107.8 | |
| In 40 gpg | 111.5 | 107.3 | 116.0 | |
| In 80 gpg | 112.5 | 108.0 | 117.2 | |
| **6061 Aluminum:** | | **95% confidence** | | |
| Test Fluid: | Relative Efficiency (%) | low | high | |
| Reference 5% | 100.0 | 96.7 | 103.4 | Conclusion: Results in the Ca/Mg mixed hard water were slightly inferior to PREP 23 on aluminum. |
| In 0 gpg | 149.6 | 144.6 | 154.7 | |
| In 5 gpg | 136.4 | 132.0 | 140.8 | |
| In 10 gpg | 129.7 | 125.5 | 134.0 | |
| In 20 gpg | 137.5 | 133.0 | 142.2 | |
| In 40 gpg | 144.2 | 139.5 | 149.0 | |
| In 80 gpg | 129.7 | 125.4 | 134.2 | |

Comparative Example 18: PREP 26-1.0-MAA SYBO+TEA 1:1

PREP 26 is an example of the compositions disclosed in US 2009/0209441. The product of PREP 26 was dispersed at 1.5 wt % in 0, 200, 400, 600, 800 and 1000 ppm hard water containing dye. These aqueous dispersions were incubated for three days at 40° C. and examined for signs of separation. More or less complete dropout occurred at >400 ppm water hardness; a sticky residue sank to the bottom of the higher-hardness dilutions. The 0 ppm dilution was almost clear. The 0, 200, and 400 ppm dilutions were tested after re-dispersion of cream layers by Microtap evaluation on 6061 aluminum and 1018 steel. The results are shown in Table 19 below. It was also noted that over a period of several more days at room temperature, precipitation occurred in the 400 ppm hardness dilution as well.

TABLE 19

| 1018 Steel: | | 95% confidence | | |
|---|---|---|---|---|
| Test Fluid: | Relative Efficiency (%) | low | high | |
| Reference, 10% | 100.0 | 96.9 | 103.2 | Conclusion: Despite good performance on the Microtap test up to 400 ppm hardness, the severe dropout at higher hardness levels is a significant shortcoming. |
| In 0 ppm | 106.3 | 102.9 | 109.8 | |
| In 200 ppm | 138.0 | 133.8 | 142.3 | |
| In 400 ppm | 109.9 | 106.6 | 113.4 | |
| **6061 Aluminum:** | | **95% confidence** | | |
| Test Fluid: | Relative Efficiency (%) | low | high | |
| Reference, 5% | 100.0 | 97.8 | 102.3 | Conclusion: Performance of PREP 26 in this test on aluminum dropped off significantly at 200 ppm hardness. |
| In 0 ppm | 100.0 | 97.5 | 102.6 | |
| In 200 ppm | 77.7 | 75.7 | 79.8 | |
| In 400 ppm | 173.8 | 169.6 | 178.2 | |

Comparative Example 19: PREP 7-1.0-MAA SYBO+FOH-9 1:1 (no MPEG)

PREP 7 did not have any methoxypolyethylene glycol. The product of PREP 7 readily dispersed at 1 wt % in DI water with 0.5% TEA to give an emulsion exhibiting ~1 vol % cream separation. In 200 ppm and higher hardness water with 0.5% TEA, however, the material would not disperse. Essentially complete separation of an oil phase was observed with nearly clear water below. This demonstrates that without the MPEG moiety that hard water tolerance is completely lacking.

Comparative Example 20: PREP 12-1.0-MAA SYBO+MPEG 350 1:1

For PREP 12, only MPEG was used; there was no hydrophobic alcohol having at least 9 carbon atoms (fatty alcohol). PREP 12 was dissolved at 1 wt % with 0.5 wt % TEA and dye in mixed Ca/Mg hard water as in Example 14. The dilutions were incubated overnight at 40° C. and then for an additional five days at room temperature. There was no cream or oil separation in any of the samples. All dilutions were clear to very slightly hazy, indicative of microemulsions. All six dilutions were tested by Microtap on 1018 Steel and 6061 Aluminum. The results are shown in Table 20 below.

Comparative Example 21: PREP 25-1.1-MAA SYBO+PEG 1000+FOH-9 2:1:1 Equiv

In PREP 25, PEG is used in place of MPEG. PEG, having two —OH groups rather than one, coupled two maleated soybean oil molecules together resulting in a higher molecular weight distribution. The product of PREP 25 was hazy and eventually separated into two phases. PREP 25 did not readily disperse at 1 wt % in water with 0.5% TEA. This example demonstrates that the monofunctional MPEG is preferable to difunctional PEG.

Example 22: PREP 27-1.0-MAA SYBO+Ethanol+MPEG 350 2:1:1

For PREP 27, a very low mw alcohol (ethanol) was used in combination with MPEG 350 to react with the maleated soybean oil. PREP 27 was dissolved at 1 wt % with 0.5 wt % TEA in mixed Ca/Mg hard water as in Example 14. The dilutions were incubated overnight at 40° C. All six dilutions were tested by Microtap on 1018 Steel and 6061 Aluminum. The results are shown in Table 21 below.

TABLE 20

| 1018 Steel: | | 95% confidence | | |
|---|---|---|---|---|
| Test Fluid: | Relative Efficiency (%) | low | high | |
| Reference 10% | 100.0 | 95.7 | 104.5 | Conclusion: The PREP 12 product at 1 wt % with 0.5% TEA performs comparably to the reference fluid at 10 wt % in low hardness water and outperforms it in high hardness (>20 gpg). |
| In 0 gpg | 96.6 | 92.3 | 101.0 | |
| In 5 gpg | 98.1 | 94.0 | 102.4 | |
| In 10 gpg | 99.7 | 95.5 | 104.2 | |
| In 20 gpg | 103.3 | 98.7 | 108.0 | |
| In 40 gpg | 108.1 | 103.5 | 112.9 | |
| In 80 gpg | 114.0 | 109.0 | 119.3 | |
| **6061 Aluminum:** | | **95% confidence** | | |
| Test Fluid: | Relative Efficiency (%) | low | high | |
| Reference 5% | 100.0 | 97.2 | 102.9 | Conclusion: The PREP 12 product at 1 wt % with 0.5% TEA significantly underperforms the reference fluid at 5 wt % at all hardness levels below 80 gpg. This is in contrast to PREP 8 and PREP 23 (Examples 1 and 16) which significantly outperformed the reference fluid at all hardness levels. |
| In 0 gpg | 71.5 | 69.5 | 73.6 | |
| In 5 gpg | 72.7 | 70.8 | 74.7 | |
| In 10 gpg | 76.2 | 74.1 | 78.4 | |
| In 20 gpg | 82.3 | 80.0 | 84.7 | |
| In 40 gpg | 95.2 | 92.6 | 97.9 | |
| In 80 gpg | 107.0 | 103.9 | 110.1 | |

TABLE 21

| 1018 Steel: | | 95% confidence | | |
|---|---|---|---|---|
| Test Fluid: | Relative Efficiency (%) | low | high | |
| Reference 10% | 100.0 | 96.3 | 103.8 | Conclusion: The PREP 27 |
| In 0 gpg | 117.3 | 112.9 | 121.8 | product at 1 wt % with 0.5% |
| In 5 gpg | 114.2 | 110.1 | 118.4 | TEA performs significantly |
| In 10 gpg | 113.4 | 109.3 | 117.7 | better than the reference |
| In 20 gpg | 111.1 | 107.0 | 115.3 | fluid at 10 wt % at all tested |
| In 40 gpg | 114.6 | 110.5 | 118.9 | water hardness levels. |
| In 80 gpg | 127.7 | 122.9 | 132.7 | |
| **6061 Aluminum:** | | **95% confidence** | | |
| Test Fluid: | Relative Efficiency (%) | low | high | |
| Reference 5% | 100.0 | 96.7 | 103.4 | Conclusion: The PREP 27 |
| In 0 gpg | 129.2 | 124.8 | 133.7 | product at 1 wt % with 0.5% |
| In 5 gpg | 116.0 | 112.2 | 119.8 | TEA performs significantly |
| In 10 gpg | 126.0 | 121.8 | 130.3 | better than the reference |
| In 20 gpg | 132.4 | 127.9 | 137.0 | fluid at 5 wt % at all tested |
| In 40 gpg | 148.4 | 143.5 | 153.5 | water hardness levels. |
| In 80 gpg | 145.7 | 140.7 | 150.8 | |

Example 23: PREP 28-1.0-MAA SYBO+Oleyl Alcohol+MPEG 350 2:1:1

For PREP 28, a higher mw alcohol (oleyl alcohol) was used in combination with MPEG 350 to react with the maleated soybean oil. PREP 28 was dissolved at 1 wt % with 0.5 wt % TEA in mixed Ca/Mg hard water as in Example 14. The dilutions were incubated overnight at 40° C. All six dilutions were tested by Microtap on 1018 Steel and 6061 Aluminum. The results are shown in Table 22 below.

TABLE 22

| 1018 Steel: | | 95% confidence | | |
|---|---|---|---|---|
| Test Fluid: | Relative Efficiency (%) | low | high | |
| Reference 10% | 100.0 | 93.7 | 106.7 | Conclusion: The PREP 28 |
| In 0 gpg | 133.0 | 124.4 | 142.1 | product at 1 wt % with 0.5% |
| In 5 gpg | 122.1 | 114.6 | 130.0 | TEA performs significantly |
| In 10 gpg | 121.2 | 113.6 | 129.2 | better than the reference |
| In 20 gpg | 110.7 | 103.6 | 118.2 | fluid at 10 wt % at all tested |
| In 40 gpg | 117.7 | 110.3 | 125.5 | water hardness levels. |
| In 80 gpg | 134.7 | 126.0 | 144.0 | |
| **6061 Aluminum:** | | **95% confidence** | | |
| Test Fluid: | Relative Efficiency (%) | low | high | |
| Reference 5% | 100.0 | 96.9 | 103.2 | Conclusion: The PREP 28 |
| In 0 gpg | 164.9 | 159.8 | 170.3 | product at 1 wt % with 0.5% |
| In 5 gpg | 151.0 | 146.5 | 155.7 | TEA performs significantly |
| In 10 gpg | 154.6 | 149.9 | 159.5 | better than the reference |
| In 20 gpg | 160.0 | 155.0 | 165.1 | fluid at 5 wt % at all tested |
| In 40 gpg | 141.3 | 137.0 | 145.7 | water hardness levels. |
| In 80 gpg | 134.9 | 130.6 | 139.2 | |

Unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (e.g. $Ca^{2+}$ and $Mg^{2+}$) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Any of the documents referred to above are incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined.

Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A composition prepared from an adduct of mono-maleated polyunsaturated vegetable oil and an alcohol mixture comprising a hydrophobic alcohol comprising at least one linear or branched $C_9$ to $C_{11}$ oxo alcohol, linear or branched $C_{12}$ to $C_{14}$ fatty alcohol, or combinations thereof and methoxypolyethylene glycol having a number average molecular weight ($M_n$) of at least 350.

2. The composition of claim 1, wherein said methoxypolyethylene glycol has a number average molecular weight ($M_n$) of at least 550.

3. The composition of claim 1, wherein said mono-maleated polyunsaturated vegetable oil is prepared by mixing maleic anhydride and a polyunsaturated vegetable oil in a molar ratio of maleic anhydride to polyunsaturated vegetable oil of 1:<2.

4. The composition of claim 1, wherein a molar ratio of said mono-maleated polyunsaturated vegetable oil to said alcohol mixture ranges from 2:1 to 1:2.

5. The composition of claim 1, wherein the polyunsaturated vegetable oil is soybean oil.

6. The composition of claim 1, wherein said adduct is salted using an alkali metal base or an amine.

7. The composition of claim 6, wherein said alkali metal base is a sodium or potassium base.

8. The composition of claim 6, wherein said amine is a tertiary amine.

9. The composition of claim 8, wherein said tertiary amine is a tertiary alkanolamine.

10. The composition of claim 9, wherein said tertiary amine comprises at least one of triethanolamine, N,N-dimethylethanolamine, N-butyldiethanolamine, N,N-diethylethanolamine, or N,N-dibutylethanolamine.

11. The composition of claim 10, wherein said tertiary amine comprises triethanolamine.

12. An aqueous metalworking fluid comprising the composition of claim 1.

13. The fluid of claim 12, wherein said composition is present in an amount of less than 3 wt % based on a total weight of said aqueous metalworking fluid.

14. The fluid of claim 12, wherein said composition remains dispersed in said aqueous metalworking fluid when said aqueous metalworking fluid has a hardness of at least 400 ppm $CaCO_3$, based on a total weight of said aqueous metalworking fluid.

15. A method of lubricating a metal component, said method comprising contacting said metal component with the aqueous metalworking fluid of claim 12.

16. The method of claim 15, wherein said metal component is aluminum or steel.

17. A method of improving the stability and/or lubricity of a metalworking fluid, said method comprising adding the composition of claim 1 to said metalworking fluid.

18. The method of claim 17 wherein said composition is present in an amount of less than 3 wt % based on a total weight of said metalworking fluid.

* * * * *